US012638210B2

(12) United States Patent
Welch et al.

(10) Patent No.: US 12,638,210 B2
(45) Date of Patent: May 26, 2026

(54) SYSTEMS AND METHODS FOR SUPPLYING STORED HEAT TO A VAPOR COMPRESSION SYSTEM

(71) Applicant: Copeland LP, Sidney, OH (US)

(72) Inventors: Andrew M. Welch, Franklin, OH (US); James Scott Fraser, Springboro, OH (US); Damiel Faxon, Dayton, OH (US); Winfield S. Morter, Dayton, OH (US)

(73) Assignee: Copeland LP, Sidney, OH (US)

( * ) Notice: Subject to any disclaimer, the term of this patent is extended or adjusted under 35 U.S.C. 154(b) by 143 days.

(21) Appl. No.: 18/516,307

(22) Filed: Nov. 21, 2023

(65) Prior Publication Data

US 2025/0164141 A1 May 22, 2025

(51) Int. Cl.
*F24F 11/875* (2018.01)
*F24F 11/84* (2018.01)

(52) U.S. Cl.
CPC ..... *F24F 11/875* (2018.01); *F24F 11/84* (2018.01)

(58) Field of Classification Search
CPC ..... F24F 11/875; F24F 11/84
See application file for complete search history.

(56) References Cited

U.S. PATENT DOCUMENTS 4,299,277 A 11/1981 McGregor
4,338,919 A 7/1982 Hwang
5,778,683 A * 7/1998 Drees ..... F24F 5/0017 62/99
8,099,972 B2 1/2012 Dupraz
8,931,277 B2 1/2015 Peterson et al.
8,991,183 B2 3/2015 Stiesdal
9,217,423 B2 12/2015 Chen et al.
(Continued)

FOREIGN PATENT DOCUMENTS

CA 2638235 A1 2/2010
CN 101408357 A * 4/2009
(Continued)

OTHER PUBLICATIONS

Maeda et al., Heat Storage Device, Mar. 4, 1996, JPH0820195B2, Whole Document (Year: 1996).*
(Continued)

*Primary Examiner* — Larry L Furdge
(74) *Attorney, Agent, or Firm* — Armstrong Teasdale LLP

(57) ABSTRACT

A vapor compression system includes a primary loop, an auxiliary loop, and first and second valves. The primary loop includes an indoor heat exchanger, an outdoor heat exchanger, and a compressor. The first valve is positionable in first and second positions, such that the first valve fluidly connects the indoor heat exchanger to the compressor in the first position. The second valve is positionable in third and fourth positions, such that the second valve fluidly connects the indoor and outdoor heat exchangers in the third position. The auxiliary loop includes a thermal storage unit, a supply duct, and a return duct. The supply duct fluidly connects a thermal storage unit exit to the indoor heat exchanger when the first valve is in the second position. The return duct fluidly connects a thermal storage unit inlet to the indoor heat exchanger when the second valve is in the fourth position.

14 Claims, 12 Drawing Sheets

(56) References Cited

U.S. PATENT DOCUMENTS

| | | | | |
|---|---|---|---|---|
| 10,024,551 | B2 | 7/2018 | Lin | |
| 10,060,296 | B2 | 8/2018 | Friesth | |
| 10,072,896 | B2 | 9/2018 | Jacobs et al. | |
| 11,162,387 | B1 | 11/2021 | McCormick | |
| 11,480,395 | B2 | 10/2022 | Ma | |
| 2006/0288724 | A1* | 12/2006 | Ambs | F25B 30/06 62/260 |
| 2016/0313033 | A1 | 10/2016 | Chen et al. | |

FOREIGN PATENT DOCUMENTS

| | | | | |
|---|---|---|---|---|
| CN | 109579176 | A | * | 4/2019 |
| JP | S54121449 | A | | 9/1979 |
| JP | H04288458 | A | | 10/1992 |
| JP | H0820195 | B2 | * | 3/1996 |
| JP | 2001066001 | A | | 3/2001 |
| WO | 2010102640 | A1 | | 9/2010 |
| WO | 2017002127 | A1 | | 1/2017 |

OTHER PUBLICATIONS

Wang et al., Balcony Wall Hanging Sole Energy Air Source . . . , Apr. 15, 2009, CN101408357A, Whole Document (Year: 2009).*

Zhang, Seasonal Cold Accumulation All-Year Cooling System . . . , Apr. 5, 2019, CN109579176A, Whole Document (Year: 2019).*

NREL Options a Modular, Cost-Effective, Build-Anywhere Particle Thermal Energy Storage Technology, Aug. 30, 2021, National Renewable Energy Labortary, pp. 1-4.

The First Commercial Sand-based Thermal Energy Storage in the World is in Operatin—BBC News Visited Polar Night Energy, Jul. 5, 2022, pp. 1-11.

Lhendup, Tshewang et al., A Review of Ground-Coupled Solar Heat Pump with Underground Thermal Energy Storage System, 2nd AUN/SEED-Net Regional Conf. on New/Renewable Energy, Jan. 21-22, 2010, pp. 1-9.

European Extended Search Report, Application No. 24211271.2, dated Apr. 24, 2025, 10 pps.

* cited by examiner

SYSTEMS AND METHODS FOR SUPPLYING STORED HEAT TO A VAPOR COMPRESSION SYSTEM

FIELD

The field relates generally to heating, ventilation, and air conditioning (HVAC) systems, and more particularly, to vapor compression systems usable as heat pumps.

BACKGROUND

The vapor compression cycle is used to regulate the temperature and humidity of an interior space. In some applications, vapor compression systems are built to be reversible, such that the same system is operable to heat or cool an interior space as needed. Heat pumps, or reversible vapor compression systems configurable as a heat pump, are often used to heat indoor spaces in very cold environments. However, subjecting the outdoor condensing unit to very cold temperatures requires the system to consume more energy to meet the heating requirements of the indoor space. Furthermore, the overall energy demand in cold climates can peak when many users are running heat pumps, increasing energy costs and the likelihood of an outage. There is a need for a vapor compression system that can meet the heating requirements of an indoor space in a more cost-efficient and energy-efficient way.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect relates to a vapor compression system including a primary loop, an auxiliary loop, a first valve, and a second valve. The primary loop includes an indoor heat exchanger, an outdoor heat exchanger, and a compressor operable to compress a refrigerant. The first valve is selectively positionable in a first position and a second position, such that the first valve fluidly connects the indoor heat exchanger to the compressor in the first position. The second valve is selectively positionable in a first position and a second position, such that the second valve fluidly connects the indoor heat exchanger to the outdoor heat exchanger in the first position. The auxiliary loop includes a thermal storage unit, a supply duct, and a return duct. The thermal storage unit has an inlet, an exit, and a heating duct extending therebetween. The supply duct fluidly connects the exit of the thermal storage unit to the indoor heat exchanger when the first valve is in the second position. The return duct fluidly connects the inlet of the thermal storage unit to the indoor heat exchanger when the second valve is in the second position.

Another aspect relates to a method of retrofitting a vapor compression system with an auxiliary heating loop having a thermal storage unit. The vapor compression system includes an indoor heat exchanger, an outdoor heat exchanger, and a compressor fluidly connected between the indoor and outdoor heat exchangers. The method includes fluidly connecting a first path of a first valve between the indoor heat exchanger and the compressor, fluidly connecting a first path of a second valve between the indoor heat exchanger and the outdoor heat exchanger, fluidly connecting a supply duct between the thermal storage unit and a second path of the first valve, and fluidly connecting a return duct between a second path of the second valve and the thermal storage unit.

An additional aspect relates to a controller for a vapor compression system including a primary loop and an auxiliary loop. The primary loop includes an indoor heat exchanger, an outdoor heat exchanger, and a compressor. The auxiliary loop includes a supply duct, a return duct, and a thermal storage unit having a heating duct fluidly connecting the supply duct and the return duct. The primary and auxiliary loops are connected by first and second valves. The controller includes a processor and a memory storing instructions that program the processor to operate the vapor compression system to provide a flow of refrigerant through the primary loop, determine if a condition has been satisfied, and adjust a position of the first and/or second valves when the condition is satisfied.

Yet another aspect of the disclosure relates to a vapor compression system including an indoor heat exchanger, an outdoor heat exchanger, a compressor fluidly connected between the indoor and outdoor heat exchangers, a first valve selectively positionable in a first position and a second position, a second valve selectively positionable in a first position and a second position, and a thermal storage unit fluidly connected between the first and second valves. The indoor heat exchanger, the outdoor heat exchanger, and the compressor are fluidly connected to permit a refrigerant to flow in a primary loop therebetween when the first valve is in the first position and the second valve is in the first position. The thermal storage unit and the indoor heat exchanger are fluidly connected to permit a refrigerant to flow in an auxiliary loop therebetween when the first valve is in the second position and the second valve is in the second position.

Various refinements exist of the features noted in relation to the above-mentioned aspects of the present disclosure. Additional features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Examples will be described with respect to a reversible vapor compression system operable to heat or cool an interior space. However, other example systems and methods may be used for regulating the temperature of an enclosed space.

Figure 1:
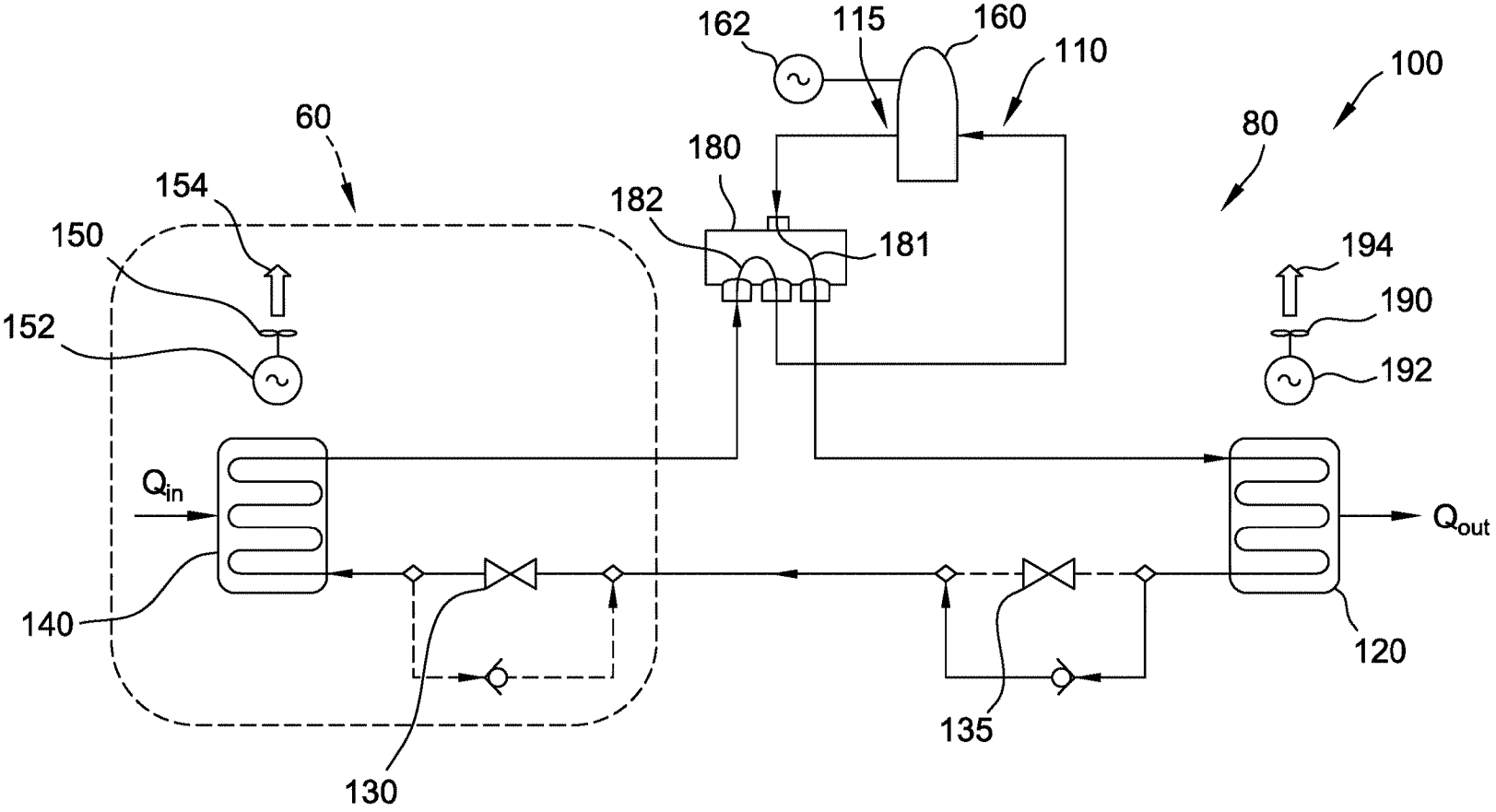
FIG. 1 is a schematic diagram of a first example vapor compression system configured in a cooling mode.
Figure 2:
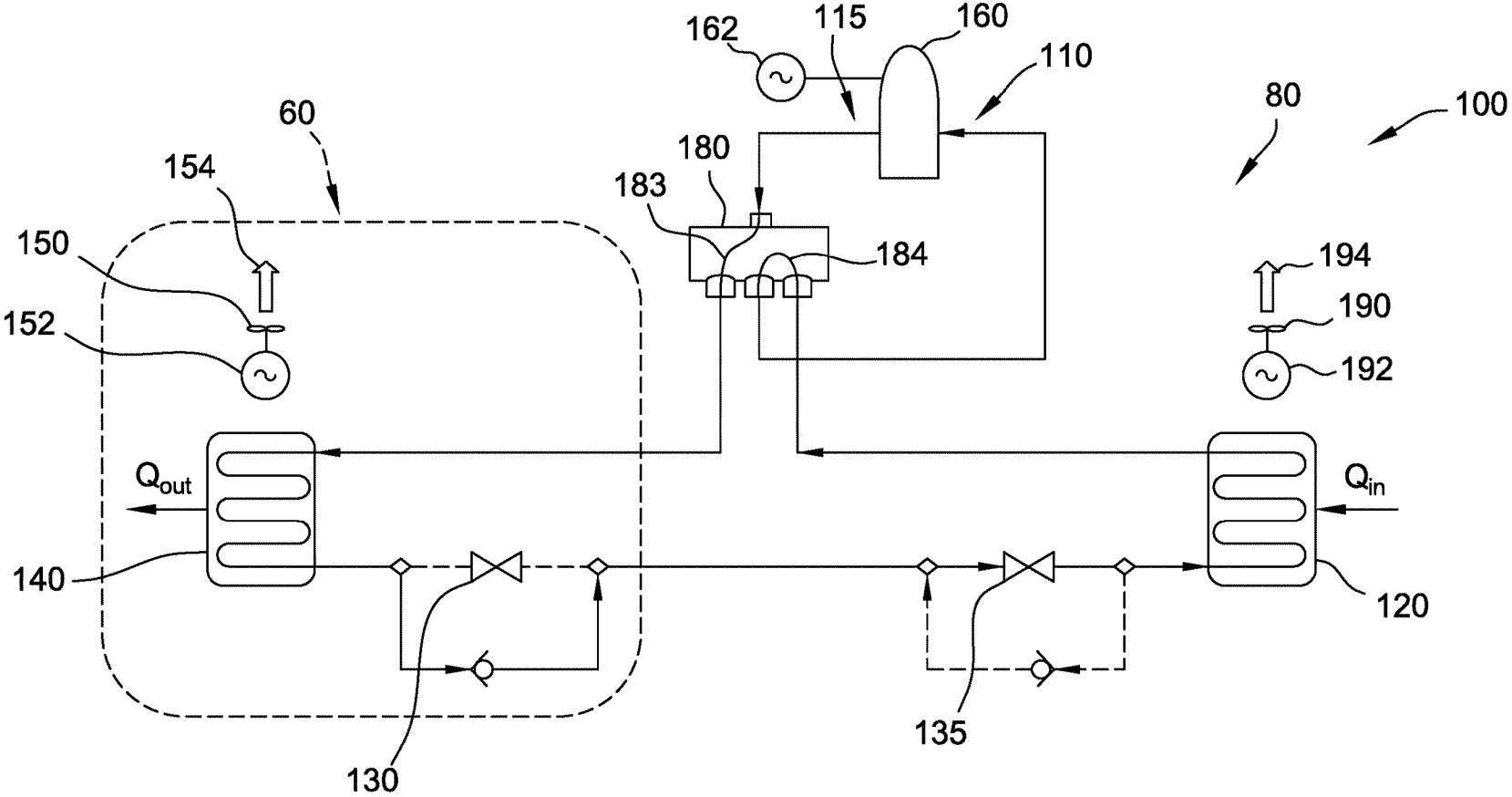
FIG. 2 is a schematic diagram of the first example vapor compression system shown in FIG. 1 configured in a heat pump heating mode.

FIGS. 1 and 2 are schematic diagrams of a first example vapor compression system 100 for cooling or heating an interior space 60 surrounded by an exterior space 80. The first system 100 includes a single, reversible, closed refrigerant loop that includes a compressor 160, a first expansion device 130, a second expansion device 135, a reversing valve 180, an indoor heat exchanger 140, and an outdoor heat exchanger 120. In further embodiments of the present disclosure (not shown), the first system 100 may be a non-reversible system such as a heat pump. In still further embodiments, the first system 100 may include multiple refrigerant loops to accommodate multiple compressors, or may operate in parallel with another system, such as a humidity control system. The configuration of the reversing valve 180 determines the direction of flow through the system, and thus whether the system is configured to cool or heat the interior space 60.

FIG. 1 illustrates the first system 100 operating in a cooling mode. Refrigerant enters the compressor 160 at a compressor inlet 110 as a low-pressure, low-temperature gas (i.e. a suction flow). The compressor 160 increases the pressure of the refrigerant, which exits the compressor 160 at the compressor exit 115 as a high-pressure, high-temperature gas (i.e. a discharge flow). The compressor 160 may be driven by a first variable frequency drive (VFD) 162 or any other suitable motor.

The discharge flow passes through a first discharge path 181 of the reversing valve 180, which directs the refrigerant to the outdoor heat exchanger 120. The outdoor heat exchanger 120 functions as a condenser, removing heat $Q_{out}$ from the refrigerant and releasing it into the exterior space 80 to convert the refrigerant gas into a high-pressure, high-temperature liquid. A first fan 190 produces a first airflow 194 from the outdoor heat exchanger 120 toward the exterior space 80, thereby exhausting warm air toward the exterior space 80. The first fan 190 may be driven by a second VFD 192 or any other suitable motor.

Downstream of the outdoor heat exchanger 120, the refrigerant bypasses the second expansion device 135 and flows through the first expansion device 130, which reduces the pressure of the refrigerant. In some embodiments, the pressure may be reduced until the liquid refrigerant temperature becomes the boiling point temperature at that pressure, and the refrigerant becomes a two-phase mixture as some of the liquid refrigerant boils and turns into a gas. The first expansion device 130 may be a fixed orifice, a thermal expansion valve, an electronic expansion valve, or another type of expansion device that allows the first system 100 to function as described.

The first expansion device 130 is fluidly connected to the indoor heat exchanger 140, which receives low-pressure, low-temperature liquid refrigerant or a two-phase mixture of liquid and gaseous refrigerant at its inlet. The indoor heat exchanger 140 functions as an evaporator, with the refrigerant absorbing heat Qin from the interior space 60 to change the phase of the refrigerant from liquid to gas. A second fan 150 produces a second airflow 154 across the indoor heat exchanger 140 toward the interior space 60, thereby cooling the interior space 60. The second fan 150 may be driven by a third variable frequency drive (VFD) 152 or by any other suitable motor. The gaseous refrigerant flow then passes through a first suction path 182 of the reversing valve 180 and is returned to the compressor inlet 110 as a suction flow.

FIG. 2 illustrates the first system 100 operating in a heating mode. Similarly to the cooling mode, refrigerant enters the compressor 160 at the compressor inlet 110 as a low-pressure, low-temperature gas (i.e. a suction flow). The compressor 160 increases the pressure of the refrigerant, which exits the compressor 160 at the compressor exit 115 as a high-pressure, high-temperature gas (i.e. a discharge flow). The discharge flow passes through a second discharge path 183 of the reversing valve 180, which directs the refrigerant to the indoor heat exchanger 140. The indoor heat exchanger 140 functions as a condenser, removing heat $Q_{out}$ from the refrigerant to convert the refrigerant gas into a high-pressure, high-temperature liquid. The second fan 150 produces the second airflow 154 across the indoor heat exchanger 140 toward the interior space 60, thereby releasing heat $Q_{out}$ into the interior space 60.

Downstream of the indoor heat exchanger 140, the refrigerant bypasses the first expansion device 130 and flows through the second expansion device 135, which reduces the pressure of the refrigerant. The pressure may be reduced until the liquid refrigerant's current temperature becomes the boiling point temperature at that pressure, and the refrigerant becomes a two-phase mixture as some of the liquid refrigerant boils and turns into a gas. The second expansion device 135 may be a fixed orifice, a thermal expansion valve, an electronic expansion valve, or any type of expansion device that allows the first system 100 to function as described.

The second expansion device 135 is fluidly connected to the outdoor heat exchanger 120, which receives low-pressure, low-temperature liquid refrigerant or a two-phase mixture of liquid and gaseous refrigerant at its inlet. The outdoor heat exchanger 120 functions as an evaporator, with the refrigerant absorbing heat Qin from the exterior space 80 and changing phase from a liquid to a gas. The first fan 190 produces the first airflow 194 from the outdoor heat exchanger 120 toward the exterior space 80. The gaseous refrigerant flow then passes through a second suction path 184 of the reversing valve 180 and is returned to the compressor inlet 110 as a suction flow.

Figure 3:
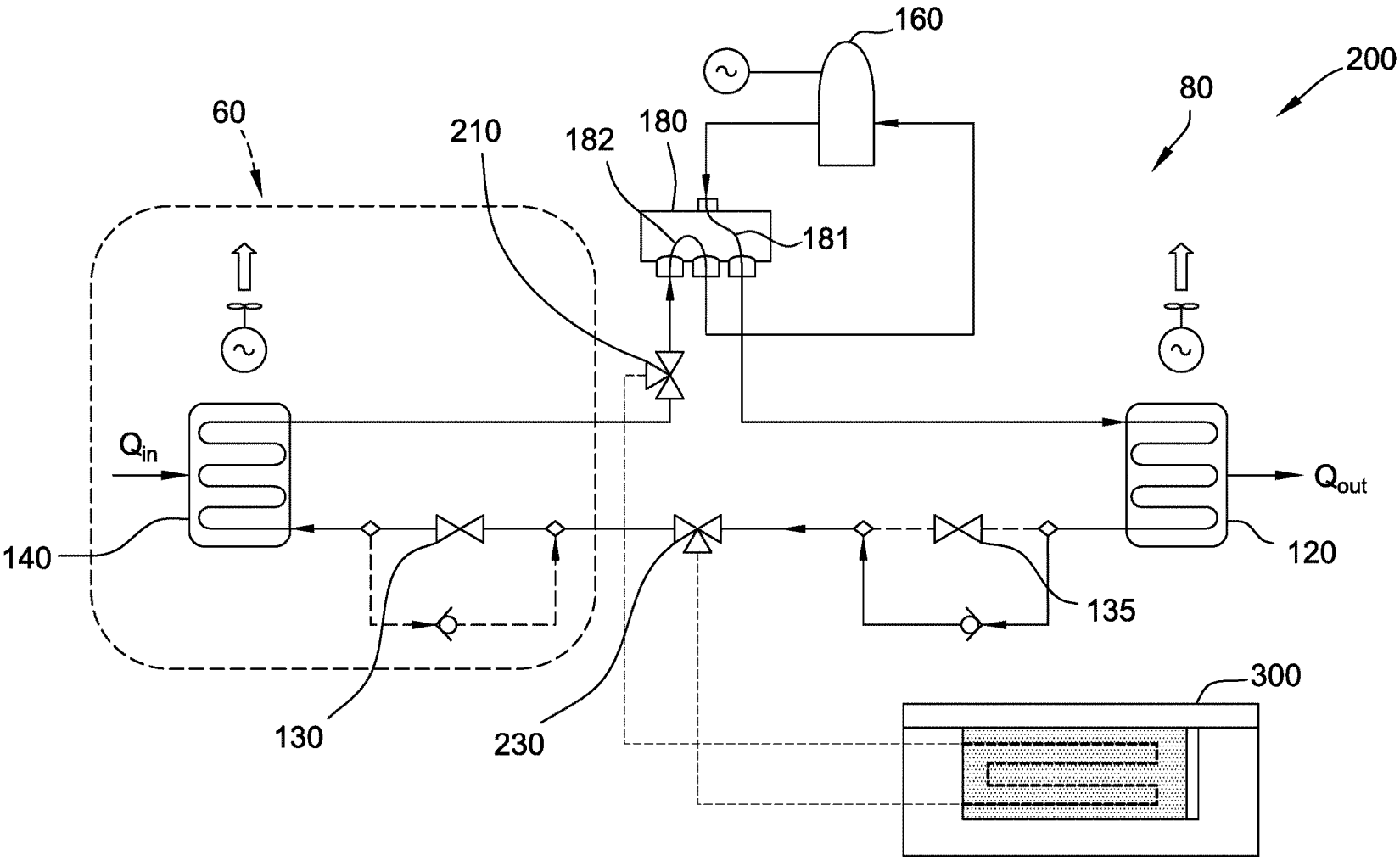
FIG. 3 is a schematic diagram of a second example vapor compression system including the first example vapor compression system shown in FIG. 2, configured in the cooling mode, and a thermal storage unit.
Figure 4:
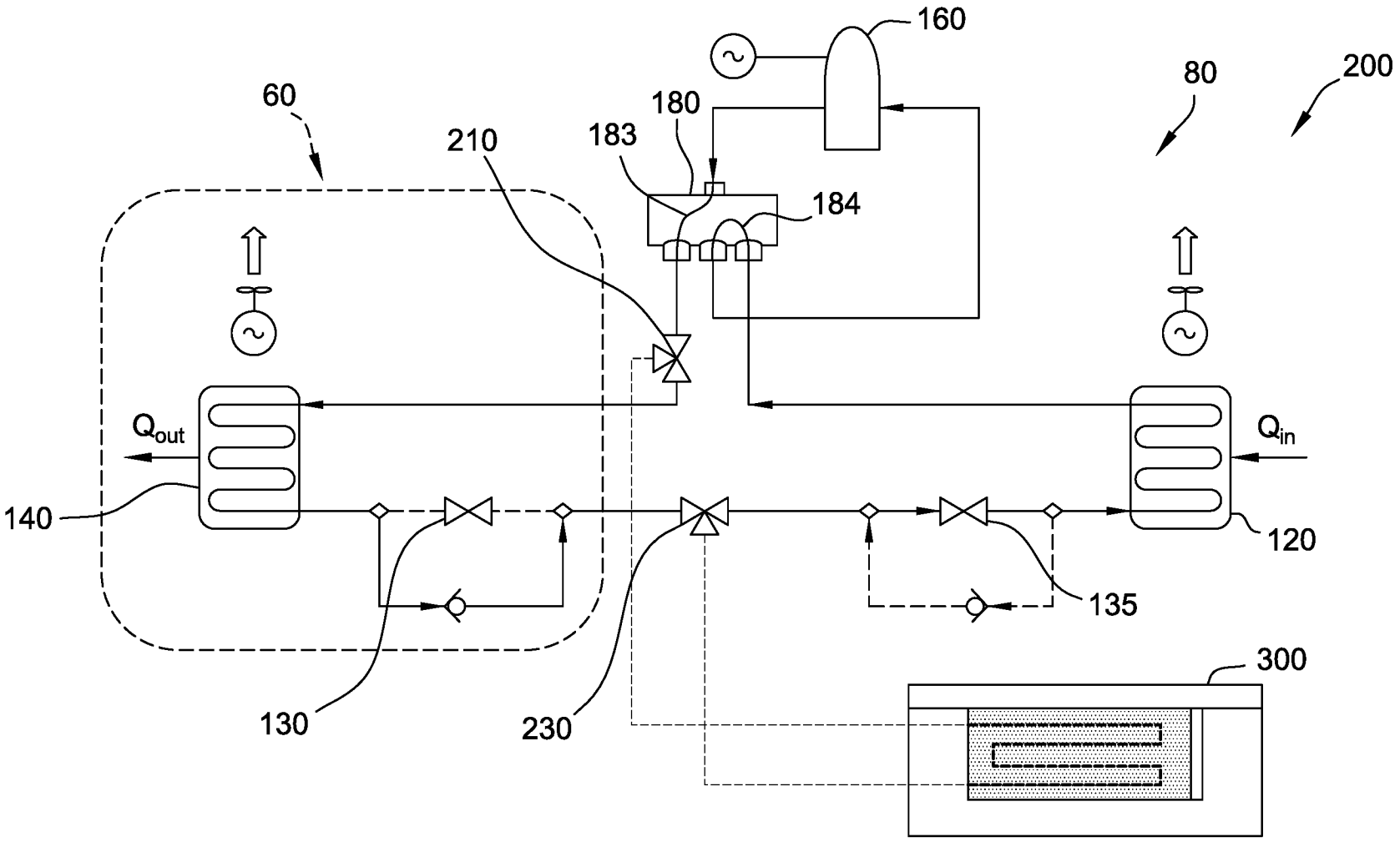
FIG. 4 is a schematic diagram of the second example vapor compression system shown in FIG. 3, configured in the heating mode.

If the first system 100 is installed in an exterior environment subject to very low temperatures (e.g., below 17 degrees Fahrenheit), the outdoor heat exchanger 120 will have limited capacity to absorb heat from the exterior space 80. FIGS. 3-5 are schematic diagrams of a second example vapor compression system 200 for heating or cooling an interior space 60 using an additional thermal storage unit 300. The second vapor compression system 200 is substantially similar to the first example vapor compression system 100 shown in FIGS. 1-2, and the description of the first system 100 applies to the second system 200 except where indicated otherwise.

In the second example system 200, the compressor 160, reversing valve 180, outdoor heat exchanger 120, first and second expansion devices 130, 135, and indoor heat exchanger 140 form part of a primary loop (shown in solid lines in FIGS. 3 and 4). The primary loop additionally includes a first valve 210 selectively positionable in a first position and a second position, and a second valve 230 selectively positionable in a first position and a second position. The second system 200 additionally includes an auxiliary loop (shown in solid lines in FIGS. 5A and 5B) fluidly connected to the primary loop, which will be discussed in greater detail further herein.

FIGS. 3 and 4 illustrate the second system 200 with the first valve 210 positioned in the first position and the second valve 230 positioned in the first position to permit refrigerant to flow through the primary loop, and prevent refrigerant from flowing through the auxiliary loop. In such configurations, refrigerant flows through a first path of the first valve 210 to fluidly connect the compressor 160 to the indoor heat exchanger 140, and through a first path of the second valve 230 to fluidly connect the indoor heat exchanger 140 to the outdoor heat exchanger 120.

When the first valve 210 is positioned in the first position and the second valve 230 is positioned in the first position, the second system 200 may operate in a cooling mode or a heating mode. In the cooling mode (FIG. 3), the second system's 200 operation is the same as, or substantially similar to, that of the first system 100 when it is configured as shown in FIG. 1. The first valve 210 is fluidly connected between the indoor heat exchanger 140 and the compressor 160 via the first suction path 182 of the reversing valve 180, and the second valve 230 is fluidly connected between the outdoor heat exchanger 120 and the indoor heat exchanger 140. In the heating mode (FIG. 4), the second system's 200 operation is the same as, or substantially similar to, that of the first system 100 when it is configured as shown in FIG. 2. The first valve 210 is fluidly connected between the compressor 160 and the indoor heat exchanger 140 via the second discharge path 183 of the reversing valve 180, and the second valve 230 is fluidly connected between the outdoor heat exchanger 120 and the indoor heat exchanger 140.

Figure 5A:
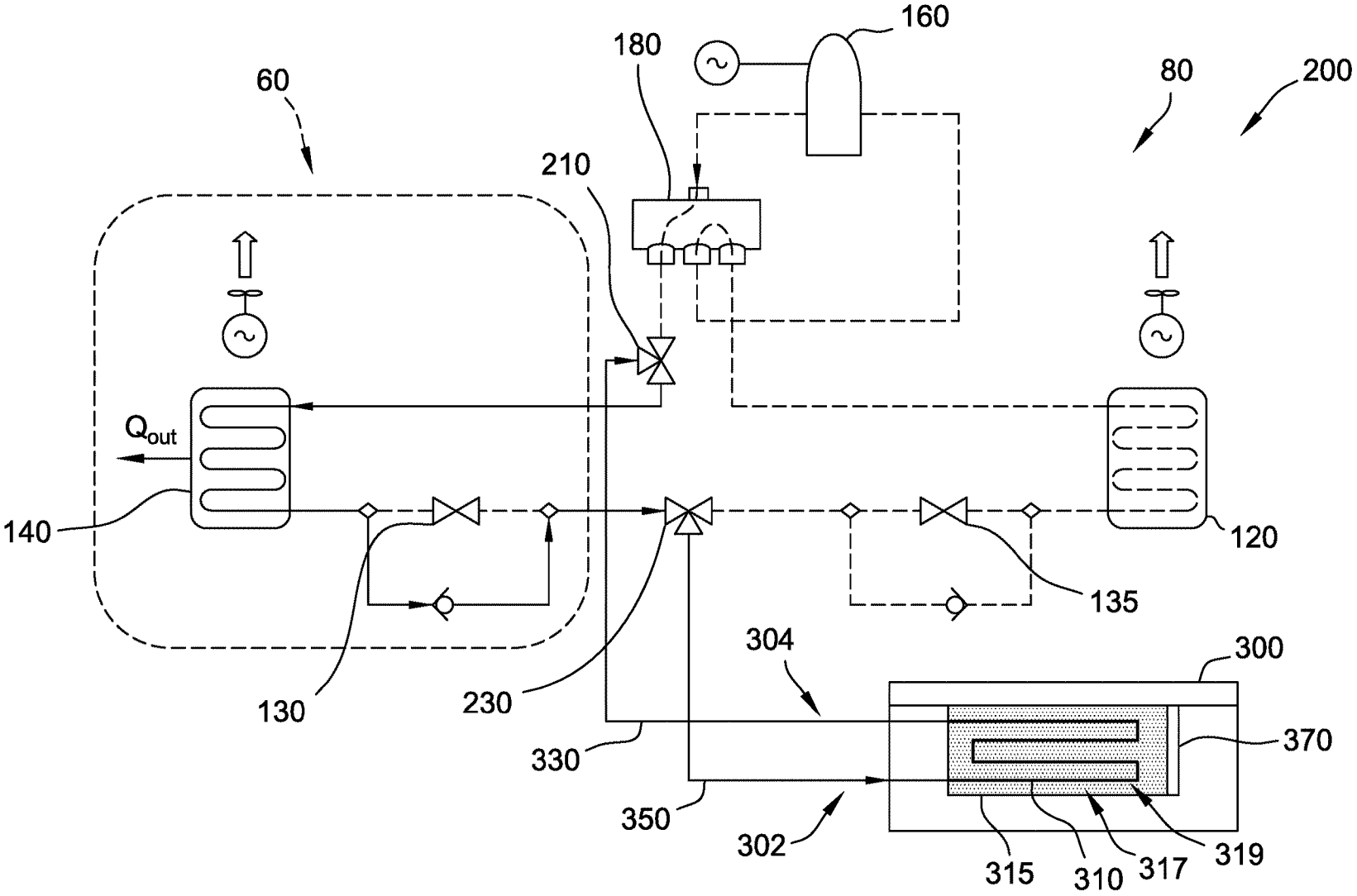
FIG. 5A is a schematic diagram of the second vapor compression system shown in FIG. 3, configured in an auxiliary heating mode.
Figure 5B:
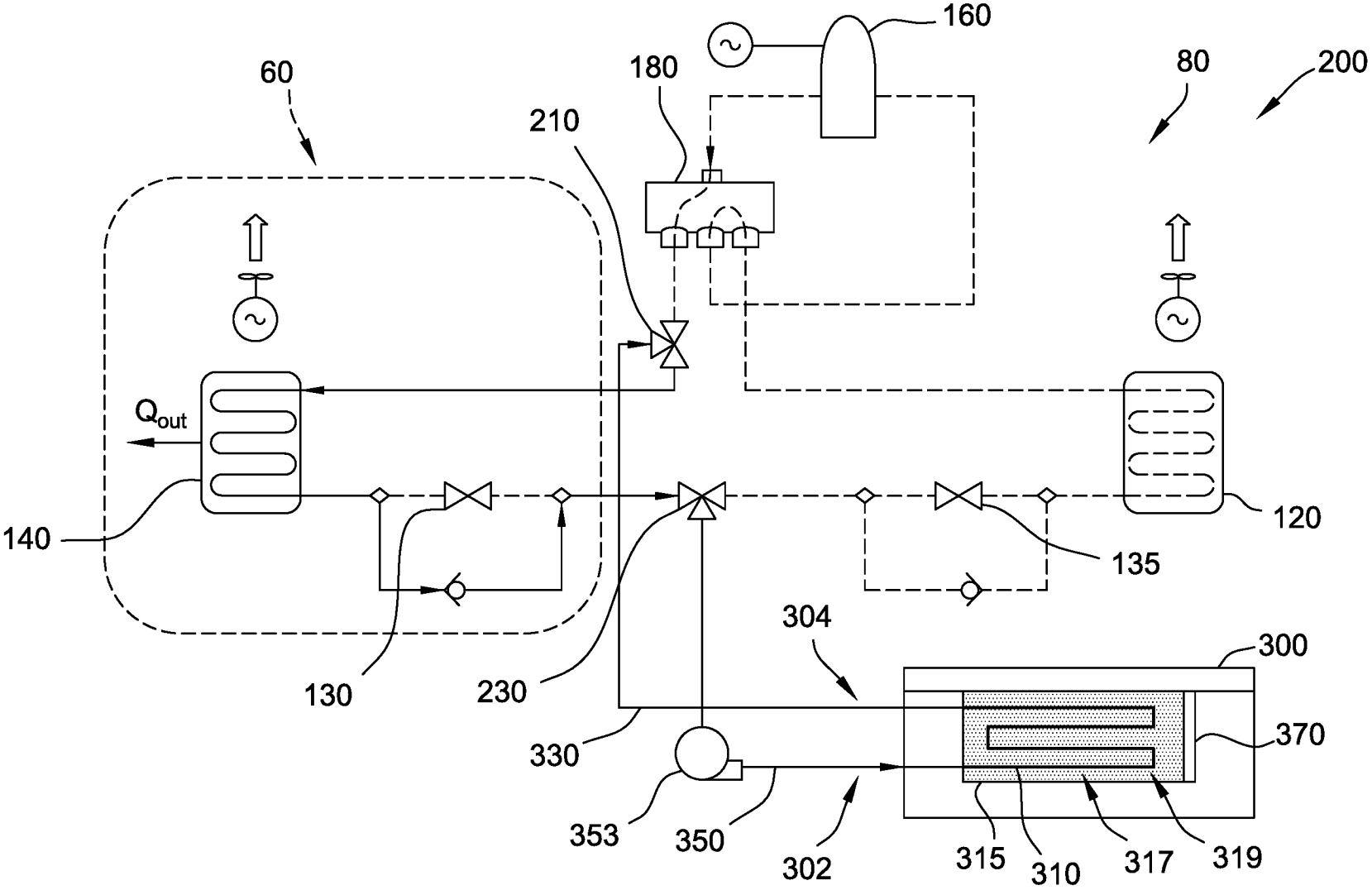
FIG. 5B is a schematic diagram of the second vapor compression system shown in FIG. 5A, configured in the auxiliary heating mode and additionally including a pump.

With reference to FIG. 5A, the auxiliary loop is fluidly connected to the primary loop via the first and second valves 210, 230. In addition to the first and second valves 210, 230, the auxiliary loop includes the thermal storage unit 300, which includes an inlet 302, an exit 304, and a heating duct 310 extending therebetween. A supply duct 330 fluidly connects the exit 304 of the thermal storage unit 300 to the indoor heat exchanger 140 via a second path of the first valve 210, and a return duct 350 fluidly connects the inlet 302 of the thermal storage unit 300 to the indoor heat exchanger 140 via a second path of the second valve 230.

The thermal storage unit 300 includes a receptacle 315 defining a cavity 317. The receptacle 315 may be constructed entirely or in part from any thermally insulating material, for example but without limitation, NUTEC Max Board HS 2400, NUTEC Max Bulk 3000 Fiber Fill, or Fiberfrax Durablanket. The cavity 317 is filled with a plurality of particles 319 having a low thermal conductivity. The particles 319 may be any suitable particles that can be heated to a high temperature (e.g. up to 1200 degrees Fahrenheit) without a significant change in their properties. For example, the particles 319 may be sand particles, pea gravel, very dry soil, a combination of two or more types of particles, or any other suitable type of particles. In further embodiments, the cavity 317 may be filled with a non-particulate material having a low thermal conductivity (e.g., between 0.15 and 0.35 W/m-K). The cavity 317 may be sized to accommodate any volume of particles 319, for example but without limitation, between 0.5 and 1000 cubic meters of particles 319.

The thermal storage unit 300 additionally includes one or more heating elements 370 operable to raise a temperature of the plurality of particles 319. In some embodiments, the one or more heating element 370 is a resistive heating element powered by a power source (not shown). In further embodiments, the heating element 370 may be any other suitable type of heating element. The heating element 370 is operable to heat the plurality of particles 319 to a high temperature, for example, between 800° F. and 1200° F. In further embodiments, the heating element 370 may be configured to heat the plurality of particles 319 to any other suitable temperature, for example but without limitation, between 200° F. and 400° F., between 400° F. and 600° F., between 600° F. and 800° F., or any other suitable temperature.

The power source may supply the heating element 370 with renewably-generated electricity, locally-generated electricity, off-peak electricity, a combination of different sources of electricity, or any other suitable source. Renewably generated electricity sources may include wind, photovoltaic, solar thermal, geothermal, nuclear, or any other suitable renewable source. Locally generated electricity may include electricity generated on the same property as the second system 200. Off-peak electricity may include electricity generated when demand falls below a threshold value or a current supply, for example, as determined by usage or pricing trends.

The heating element 370 may be powered at all times, or it may be intermittently powered. For example, the heating element 370 may be heated until a temperature sensor (not shown) determines that the plurality of particles 319 have reached a desired temperature, after which point it is powered off until the temperature sensor determines the plurality of particles 319 have fallen below the desired temperature. Additionally or alternatively, the heating element 370 may be powered when electricity demand is low, such that the plurality of particles 319 are heated when electricity is the least expensive. Additionally or alternatively, the heating element 370 may be powered when excess power generated on-site is available. The thermal energy transferred from the heating element 370 to the plurality of particles 319 can be stored for use at a later time.

When the first valve 210 is positioned in the second position and the second valve 230 is positioned in the second position, refrigerant is diverted through the auxiliary loop and circulated between the thermal storage unit 300 and the indoor heat exchanger 140 to transfer heat stored in the plurality of particles 319 to the interior space 60. In the embodiment of the second example system 200 shown in FIG. 5A, the refrigerant flow is driven by gravity, so long as the indoor heat exchanger 140 is positioned above the thermal storage unit 300. In the embodiment of the second example system 200 shown in FIG. 5B, the refrigerant flow is driven by a pump 353 positioned in the return duct 350 between the second valve 230 and the thermal storage unit 300.

Refrigerant exits the indoor heat exchanger 140, bypasses the first expansion device 130, and flows through the second path of the second valve 230. Refrigerant then passes through the return duct 350, through the inlet 302 of the thermal storage unit 300, and into the heating duct 310. The heating duct 310 is positioned within the cavity 317 such that the plurality of particles 319 surround the heating duct 310 to permit heat transfer therebetween. Specifically, the heating element 370 raises the temperature of the plurality of particles 319, which in turn raise the temperature of the refrigerant flowing through the heating duct. In the illustrated the embodiment, the heating duct 310 follows a tortuous path to maximize the surface area of the heating duct 310 in contact with the particles 319, and therefore maximize the heat transfer therebetween. In alternative embodiments, the heating duct 310 may extend directly between the inlet 302 and the exit 304 of the thermal storage unit 300.

After passing through the heating duct 310 and into thermal communication with the plurality of particles, the heated refrigerant flows through the exit of the thermal storage unit 300, through the supply duct 330, and through the second path of the first valve 210. The refrigerant is then provided to the indoor heat exchanger 140, which functions as a condenser and removes heat $Q_{out}$ from the refrigerant. The second fan 150 produces the second airflow 154 across the indoor heat exchanger 140 toward the interior space 60, thereby releasing heat $Q_{out}$ into the interior space 60.

In other embodiments (not shown), refrigerant flows through the auxiliary loop in a direction opposite to the direction show in FIG. 5A and described above. That is, refrigerant flows from the indoor heat exchanger 140, through the second path of the first valve 210, through the supply duct 330 and the exit 304 of the thermal storage unit, through the heating duct 310, through the inlet 302 of the thermal storage unit 300 and the return duct 350, through the second path of the second valve 230, and back to the indoor heat exchanger 140.

Figure 6:
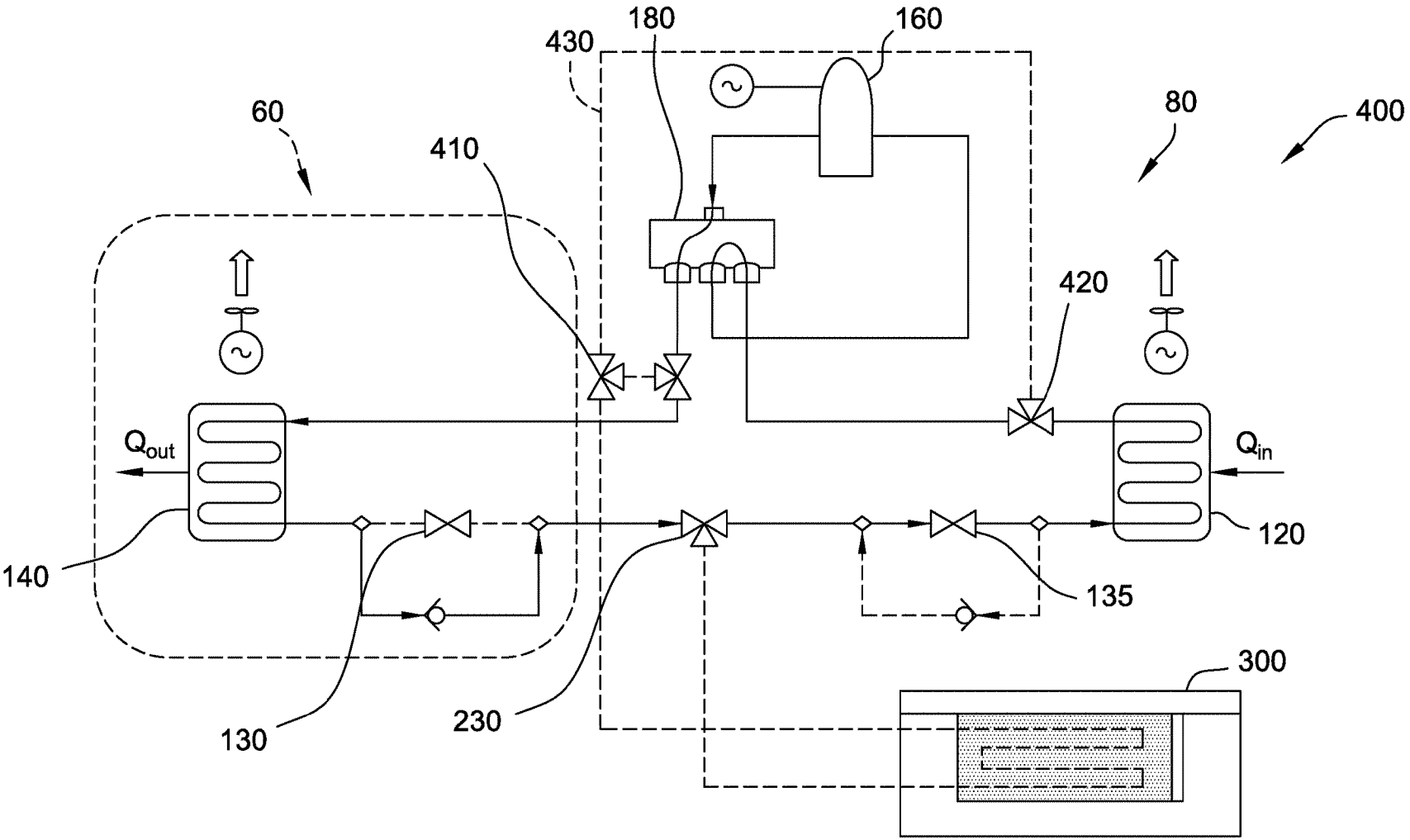
FIG. 6 is a schematic diagram of a third example vapor compression system including the second example vapor compression system shown in FIG. 3 and a defrost duct, configured in a heating mode.
Figure 7:
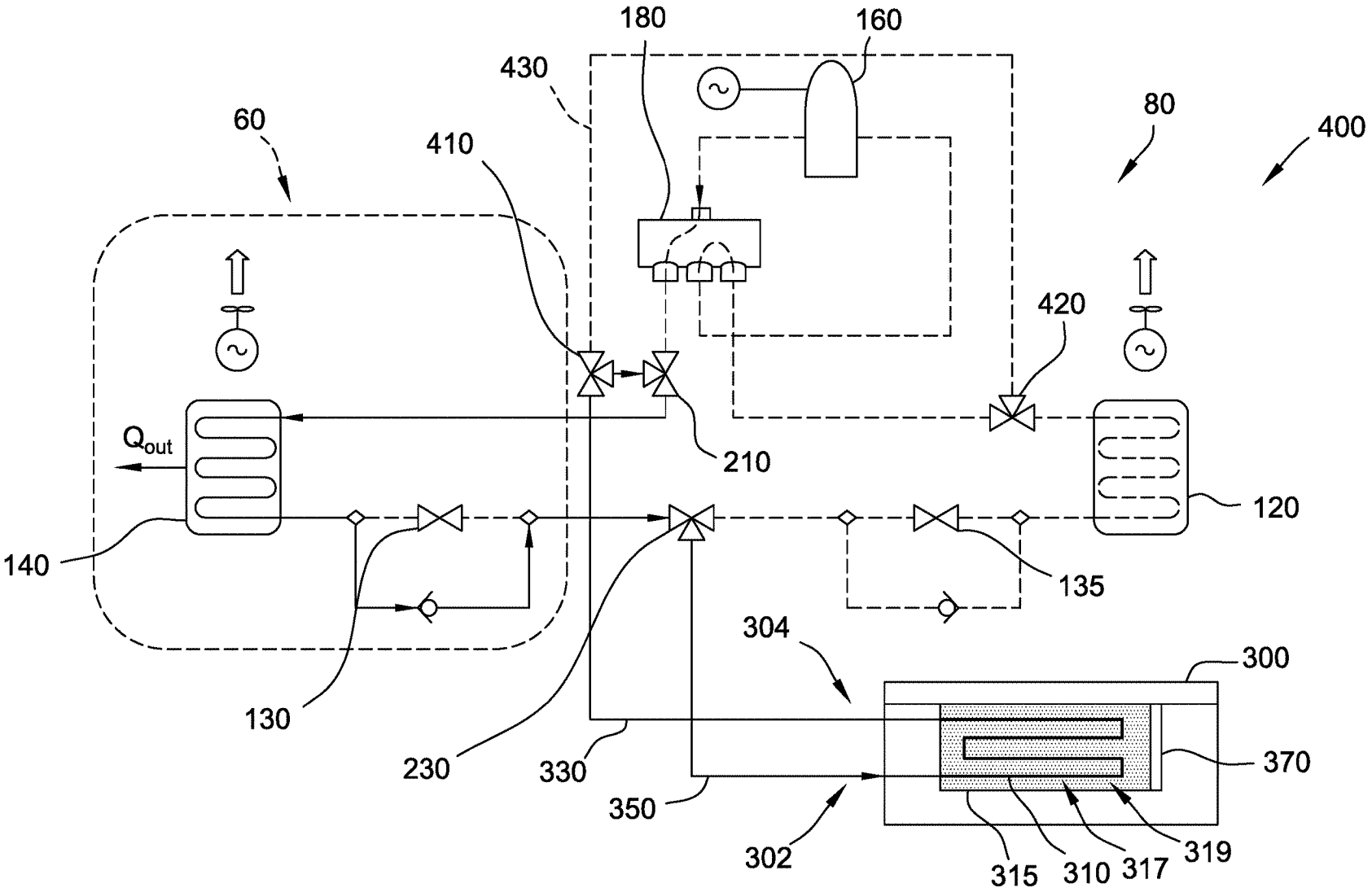
FIG. 7 is a schematic diagram of the third example vapor compression system shown in FIG. 6, configured in the auxiliary heating mode.
Figure 8:
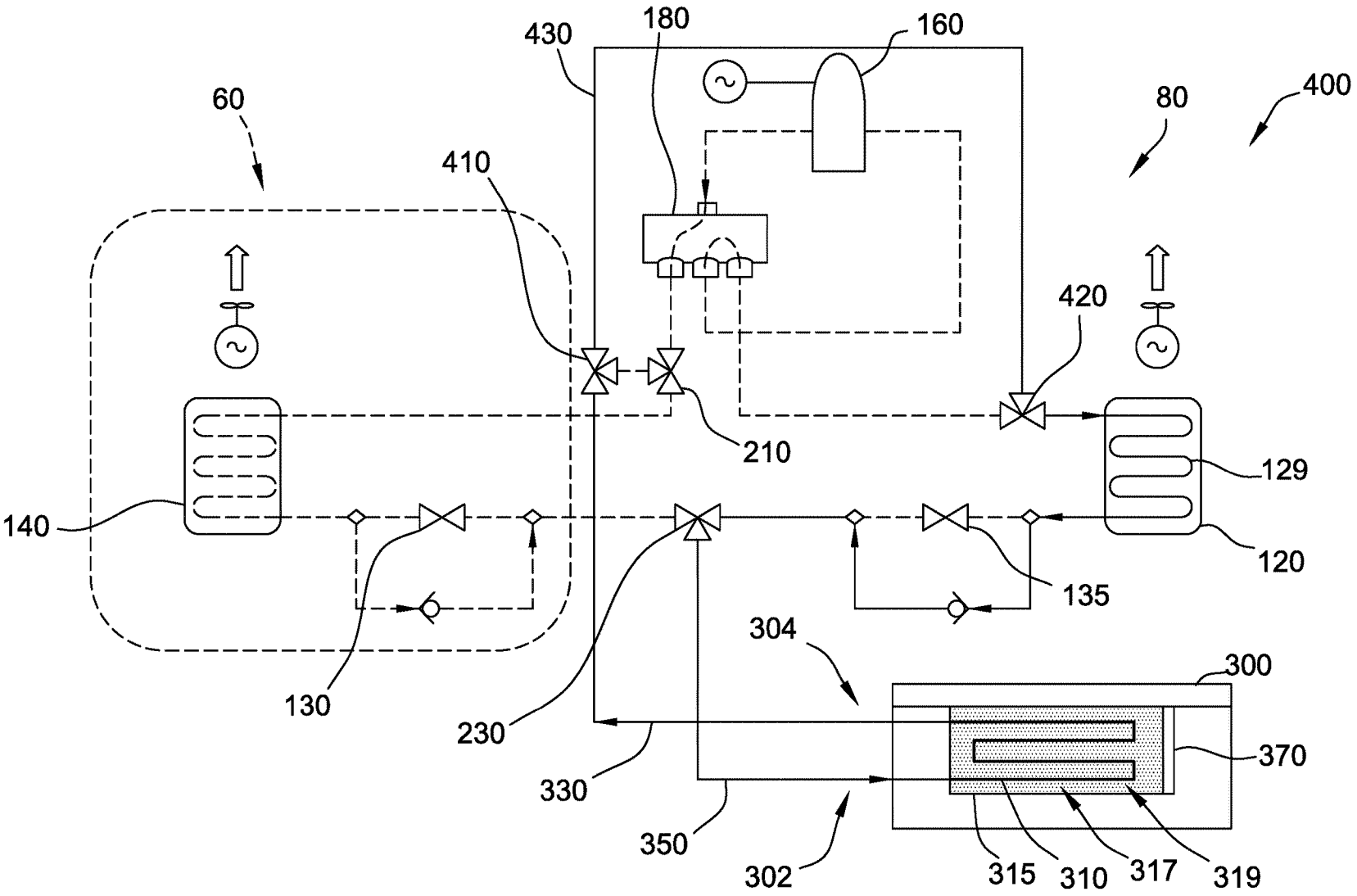
FIG. 8 is a schematic diagram of the third example vapor compression system shown in FIG. 6, configured in a defrost mode.

FIGS. 6-8 are schematic diagrams of a third example vapor compression system 400 for heating or cooling an interior space 60. The third vapor compression system 400 is substantially similar to the second example vapor compression system 200 shown in FIGS. 3-5, and the description of the second system 200 applies to the third system 400 except where indicated otherwise. In addition to the primary and auxiliary loops, the third example system 400 includes a defrost loop (shown in solid lines in FIG. 8) including a first defrost valve 410, a second defrost valve 420, and a defrost duct 430.

The first defrost valve 410 is positioned in the supply duct 330 of the auxiliary loop, and is selectively positionable in a first position (FIG. 7) and a second position (FIG. 8). The defrost duct 430 is fluidly connected between the thermal storage unit 300 and the outdoor heat exchanger 120, and the first defrost valve 410 is operable to selectively permit refrigerant to flow through the defrost duct 430. In the illustrated embodiment, the first and second defrost valves 410, 420 are both three-way valves. In further embodiments, the first and second defrost valves 410, 420 may be any other suitable type of valve, for example but without limitation, a valve assembly including two solenoid valves or two ball valves, or a reversing valve with one closed port. In still further embodiments, the first and second defrost valves 410 may each be a different type of valve.

When the first valve 210 is positioned in the first position, as shown in FIG. 6, no refrigerant flows through the first defrost valve 410 or the defrost duct 430. Refrigerant instead flows through the primary loop, and the third system 400 operates in the cooling mode or heating mode, as shown in FIGS. 3 and 4, depending on the configuration of the reversing valve 180. The refrigerant passes through the second defrost valve 420, which is configured in a first position, between the outdoor heat exchanger 120 and the reversing valve 180.

When the first valve 210 is positioned in the second position and the first defrost valve 410 is positioned in the first position, as shown in FIG. 7, refrigerant is delivered from the first defrost valve 410 to the first valve 210, and flows through the auxiliary loop. No refrigerant flows through the defrost duct 430 or the second defrost valve 420, and operation of the third system 400 as shown in FIG. 7 is the same as, or substantially similar to, operation of the second system 200 as shown in FIG. 5A.

When the first valve 210 is positioned in the second position and the first defrost valve 410 is positioned in the second position, as shown in FIG. 8, refrigerant flows through the defrost loop. Refrigerant is circulated between the thermal storage unit 300 and the outdoor heat exchanger 120 to remove (i.e., melt) ice from an exterior surface of a coil 129 of the outdoor heat exchanger 120. Refrigerant flows through the return duct 350, through the inlet 302 of the thermal storage unit 300, and into the heating duct 310.

The plurality of particles 319 transfer heat to the heating duct 310, which in turn raises the temperature of the refrigerant flowing therethrough. The heated refrigerant flows through the exit 304 of the thermal storage unit 300, through the supply duct 330, the first defrost valve 410 in the second position, the defrost duct 430, and the second defrost valve 420 positioned in a second position, before being provided to the outdoor heat exchanger 120. The heated refrigerant increases a surface temperature of the coil 129 of the outdoor heat exchanger 120, allowing ice to melt off of it without absorbing heat from the interior space 60. The refrigerant bypasses the second expansion device 135, flows through the second valve positioned in a ninth position, through the return duct 350 and back into the thermal storage unit 300.

Figure 9:
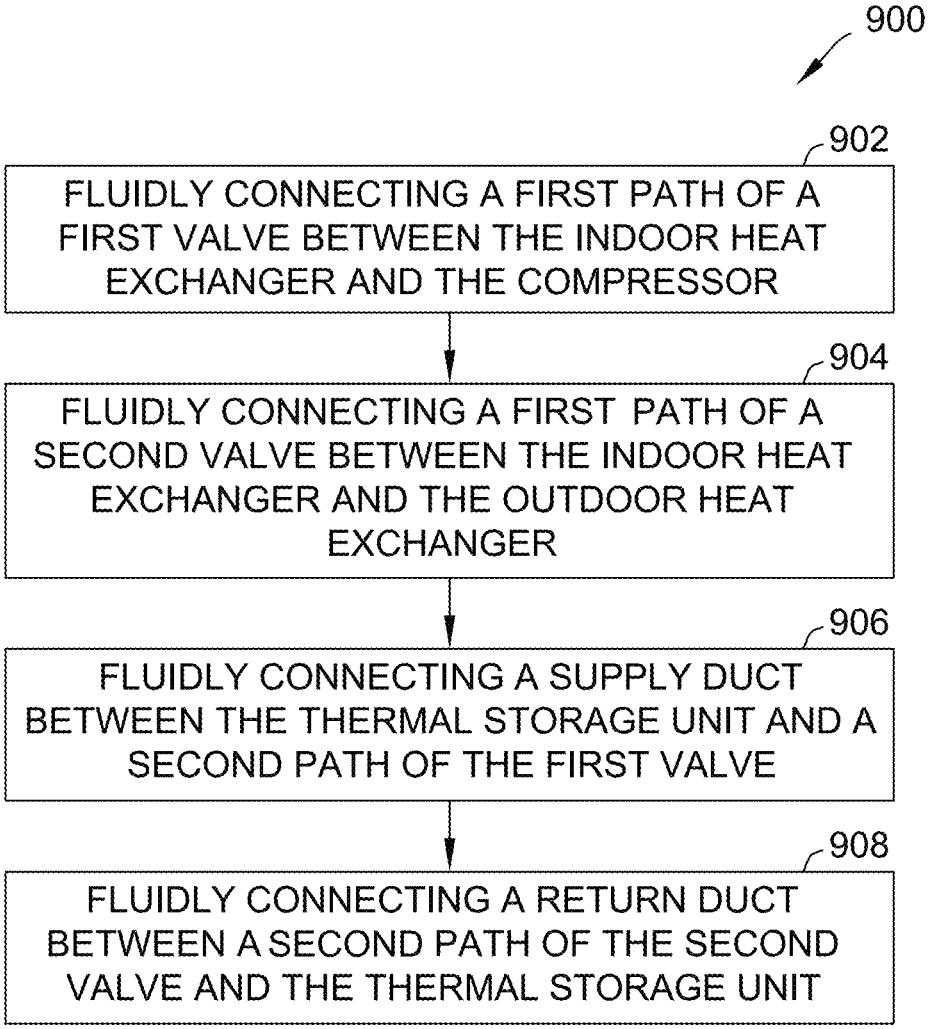
FIG. 9 is a flow chart of an example method of retrofitting a vapor compression system with an auxiliary heating loop.

FIG. 9 illustrates a flow chart of an example method 900 for retrofitting the first system 100 with the auxiliary heating loop. The method 900 includes fluidly connecting 902 the first path of the first valve 210 between the indoor heat exchanger 140 and the compressor 160, fluidly connecting 904 the first path of the second valve 230 between the indoor heat exchanger 140 and the outdoor heat exchanger 120, fluidly connecting 906 the supply duct 330 between the thermal storage unit 300 and the second path of the first valve 210; and fluidly connecting 908 the return duct 350 between the second path of the second valve 230 and the thermal storage unit 300.

Fluidly connecting 908 the return duct 350 may additionally or alternatively include connecting the return duct 350 between the second valve 230 and the thermal storage unit 300 such that the indoor heat exchanger 140 is positioned above the thermal storage unit 300 such that the flow of refrigerant through the return duct 350 is driven by gravity. That is, the system operates as a thermosiphon and the return duct 350 need not include a pump.

Figure 10:
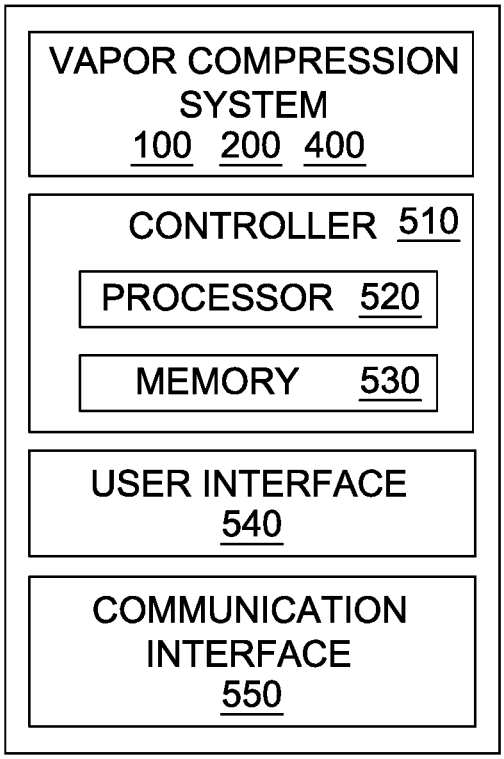
FIG. 10 is a block diagram of a control system for the vapor compression systems shown in previous figures.

With reference to FIG. 10, the disclosed vapor compression systems 100, 200, 400 each include a controller 510 programmed to control operation thereof to cool or heat the interior space 60 to a desired temperature. The controller 510 includes a processor 520 and a memory 530. The memory 530 stores instructions that program the processor 520 to operate the vapor compression system 100-200 to control the temperature of the interior space 60 to a temperature setpoint.

The controller 510 is operable to control at least one operating parameter of the vapor compression system 100, 200, 400, for example and without limitation, a speed of the first or second fan 150, 190, a position of an expansion device 130, 135, a position of a three-way valve 210, 230, 410, 420, a position of a four-way valve 180, or a speed of the compressor 160. The controller 510 may control these parameters in response to at least one measured or calculated property of the air in the interior space 60, air in the exterior space 80, or a signal from another controller. The measured properties may include, for example and without limitation, a dry bulb temperature, wet bulb temperature, dew point temperature, partial pressure of water vapor, or relative humidity.

For example, in each of the example vapor compression systems 100, 200, 400, the controller 510 is configured to control the position of the reversing valve 180 to direct the discharge flow to either the indoor or outdoor heat exchanger 140, 120, such that the system 100, 200, 400 operates in either the heating mode of the cooling mode. When the controller 510 programs operation of the vapor compression system 100, 200, 400 to direct the discharge flow to the outdoor heat exchanger 120, the controller 510 is additionally configured to bypass the second expansion device 135. When the controller 510 programs operation of the vapor compression system 100, 200, 400 to direct the discharge flow to the indoor heat exchanger 140, the controller 510 is additionally configured to bypass the first expansion device 130.

The memory 530 stores instructions that program the processor 520 to operate the vapor compression system 200, 400 to provide a flow of refrigerant through the primary loop, determine if a condition has been satisfied, and adjust a position of the first and/or second valves 210, 230 when the condition is satisfied.

Figure 11:
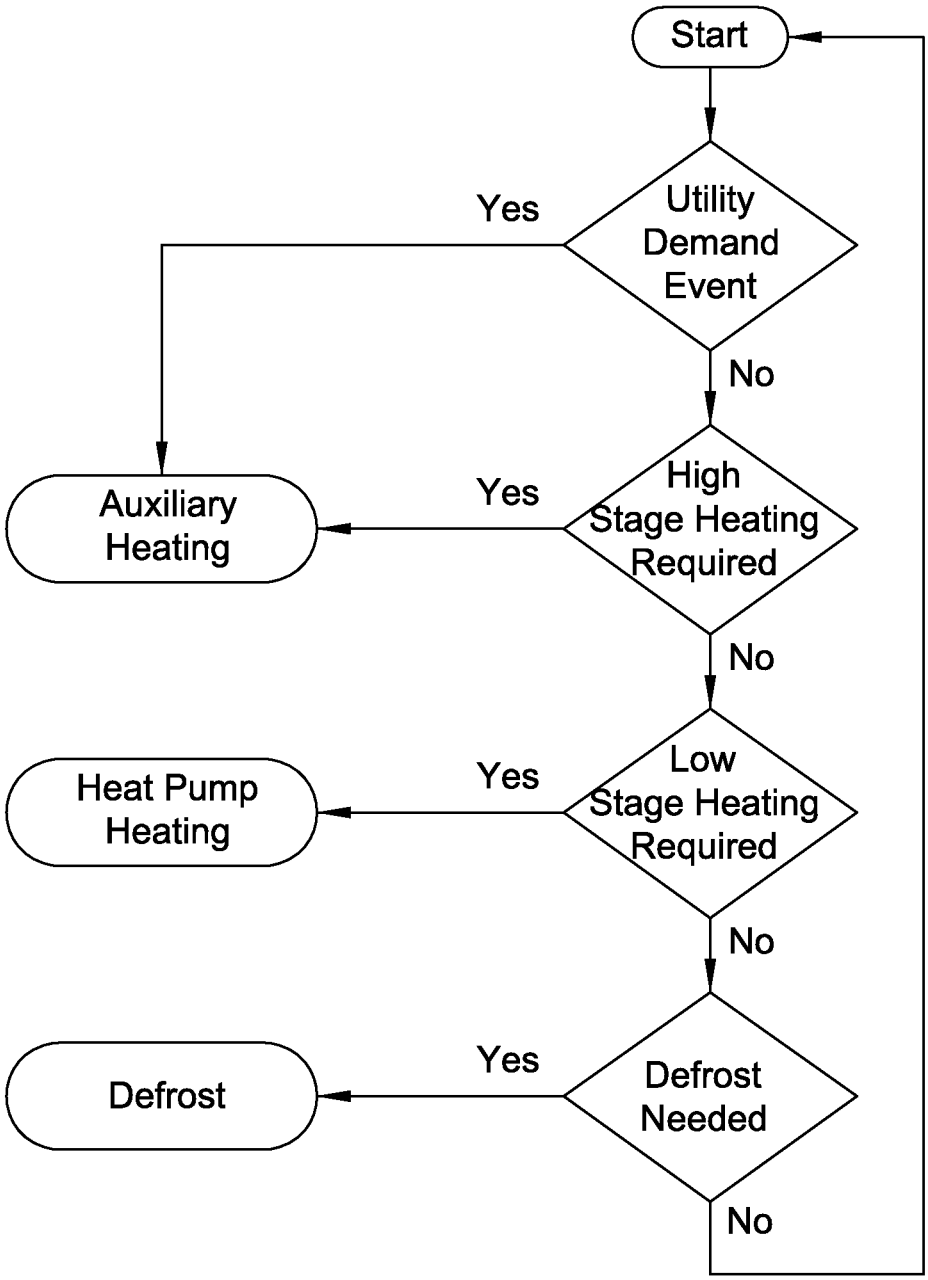
FIG. 11 is a block diagram of an example control algorithm for the vapor compression systems shown in previous figures.

FIG. 11 is a block diagram of an example control algorithm of the vapor compression system 200, 400. In some embodiments, determining if a condition has been satisfied includes determining that a high utility demand event has occurred. For example, a high utility demand event may occur when usage or pricing exceeds a threshold value, and may be indicated via a signal to an on-site smart meter.

Determining if a condition has been satisfied may additionally or alternatively include determining that high-stage heating is required. For example, high stage heating may be required when an interior air temperature set by a thermostat is not achieved via heat pump heating (i.e., heating the interior space 60 with the vapor compression system 200, 400 configured in the primary loop) over a period of 30 minutes, or if the interior air temperature continues to decline during heat pump heating.

If a high utility demand event has occurred, or if high-stage heating is required, adjusting a position of the first and/or second valve 210, 230 includes adjusting the first valve 210 to fluidly connect the indoor heat exchanger 140 to the supply duct 330 and adjusting the second valve 230 to fluidly connect the indoor heat exchanger 140 to the return duct 350, as illustrated in FIG. 5A, such that refrigerant will flow through the auxiliary loop to provide auxiliary heating to the indoor space.

Determining if a condition has been satisfied may additionally or alternatively include determining that low-stage heating is required. For example, low stage heating may be required when the air temperature in the interior space 60 drops below a temperature setpoint value by a deadband value. Additionally or alternatively, low stage heating may be required when the air temperature in the interior space 60 rises above a temperature setpoint value by a deadband value. In such embodiments, the first and second valves 210, 230 are configured in the respective first positions to permit refrigerant to flow through the primary loop to provide heat to the interior space 60 as a heat pump.

Determining if a condition has been satisfied may additionally or alternatively include determining that the coil 129 of the outdoor heat exchanger 120 needs to be defrosted. For example, determining that the coil 129 needs to be defrosted may include determining a temperature differential between air in the exterior space 80 and a saturation temperature of the outdoor heat exchanger 120 has exceeded a threshold value, for example but without limitation, a differential of more than 18° R. In this embodiment, adjusting a position of the first and/or second valves 210, 230 includes adjusting the first defrost valve 410 to fluidly connect the supply duct 330 to the outdoor heat exchanger 120, and adjusting the second valve 230 to fluidly connect the outdoor heat exchanger 120 to the return duct 350. As a result, heated refrigerant will cycle between the thermal storage unit 300 and the outdoor heat exchanger 120 to melt any ice off the coil 129.

The vapor compression system 100, 200, 400 may transition between any of high stage heating, low stage heating, auxiliary heating, defrosting, or an off mode. For example, the system 100, 200, 400 may transition from an off mode to low stage heating or from low stage heating to auxiliary heating when an air temperature of the interior space 60 drops below a temperature setpoint by a deadband value. Additionally or alternatively, the system 100, 200, 400 may transition from auxiliary heating to low stage heating or from low stage heating to the off mode when the air temperature of the interior space 60 rises above a temperature setpoint by a deadband value. Additionally or alternatively, the system 100, 200, 400 may alternate between auxiliary heating and low stage heating when an air temperature of the exterior space 80 transitions across a temperature limit (e.g. 17 degrees Fahrenheit).

The vapor compression system 100, 200, 400 also includes a user interface 540 configured to output (e.g., display) and/or receive information (e.g., from a user) associated with the vapor compression system 100-200. In some embodiments, the user interface 540 is configured to receive an activation and/or deactivation input from a user to activate and deactivate (i.e., turn on and off) or otherwise enable operation of the vapor compression system 100-200. For example, the user interface 540 can receive a temperature setpoint specified by the user. The user interface 540 in this example is operable to output information associated with one or more operational characteristics of the vapor compression system 100-200, including, for example and without limitation, warning indicators such as severity alerts, occurrence alerts, fault alerts, motor speed alerts, and any other suitable information.

The user interface 540 may include any suitable input devices and output devices that enable the user interface 540 to function as described. For example, the user interface 540 may include input devices including, but not limited to, a keyboard, mouse, touchscreen, joystick(s), throttle(s), buttons, switches, and/or other input devices. Moreover, the user interface 540 may include output devices including, for example and without limitation, a display (e.g., a liquid crystal display (LCD) or an organic light emitting diode (OLED) display), speakers, indicator lights, instruments, and/or other output devices. Furthermore, the user interface 540 may be part of a different component, such as a system controller (not shown). Other embodiments do not include a user interface 540.

The controller 510 generally controls operation of the vapor compression system 100, 200 400. The controller 510 controls operation through programming and instructions from another device or controller or is integrated with the vapor compression system 100, 200, 400 through a system controller. For example, the controller 510 receives user input from the user interface 540, and controls one or more components of the vapor compression system 100, 200, 400 in response to such user inputs. The controller 510 may also control the first fan 150 based on user input received from the user interface 540. The vapor compression system 100, 200, 400 is suitably controlled such as by a remote control interface. For example, the vapor compression system 100, 200, 400 may include a communication interface 550 configured for connection to a wireless control interface (not shown) that enables remote control and activation of the vapor compression system 100, 200, 400. The wireless control interface may be embodied on a portable computing device, such as a tablet or smartphone.

The controller 510 includes any suitable computer and/or other processing unit, including any suitable combination of computers, processing units and/or the like that may be communicatively connected to one another and that may be operated independently or in connection within one another (e.g., controller 510 may form all or part of a controller network). Controller 510 may include one or more modules or devices, one or more of which is enclosed within the vapor compression system 100, 200, 400, or may be located remote from the vapor compression system 100, 200, 400. The controller 510 may be part of the vapor compression system 100, 200, 400, or it may be part of a system controller in an HVAC system. Controller 510 and/or components of controller 510 may be integrated or incorporated within other components of the vapor compression system 100, 200, 400. The controller 510 may include one or more processor(s) 520 and associated memory device(s) 530 operable to perform a variety of computer-implemented functions (e.g., performing the disclosed calculations, determinations, and functions).

The term "processor" refers not only to integrated circuits, but also to a controller, a microcontroller, a microcomputer, a programmable logic controller (PLC), an application-specific integrated circuit, and other programmable circuits. Additionally, memory device(s) 530 of controller 510 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 530 may generally be configured to store suitable computer-readable instructions that, when implemented by the processor(s) 1220, configure or cause the controller 510 to perform various functions including, but not limited to, controlling the vapor compression system 100-200, receiving inputs from user interface 540, providing output to an operator via user interface 540, and/or various other suitable computer-implemented functions.

Technical benefits of the disclosed systems and apparatuses include: (1) The example vapor compression systems can add thermal energy to the thermal storage unit when electricity costs are low, and use the stored thermal energy to heat the interior space when electricity costs are high, when the electrical grid requires lower demand, or when the heat pump system cannot meet the space's heating requirements. (2) An existing vapor compression system can be retrofitted to include the auxiliary loop and defrost loop simply by adding two three-way valves to its existing plumbing. (3) The outdoor heat exchanger can be defrosted using thermal energy stored in the thermal storage unit, instead of absorbing heat from the interior space. (4) If the inlet of the thermal storage unit remains below the indoor heat exchanger, no pump is needed in the return duct, reducing the complexity and power requirement of the system.

The terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A vapor compression system comprising:

a primary loop comprising:

an indoor heat exchanger;

an outdoor heat exchanger; and a compressor operable to compress a refrigerant;

a first valve selectively positionable in a first position and a second position, wherein the first valve fluidly connects the indoor heat exchanger to the compressor in the first position;

a second valve selectively positionable in a first position and a second position, wherein the second valve fluidly connects the indoor heat exchanger to the outdoor heat exchanger in the first position when in a heating mode and a cooling mode; and an auxiliary loop comprising:

a thermal storage unit having an inlet, an exit, and a heating duct extending therebetween, wherein the thermal storage unit includes a cavity filled with a plurality of particles, wherein the thermal storage unit is operable at temperatures of up to 1200 F;

a supply duct fluidly connecting the exit of the thermal storage unit to the indoor heat exchanger when the first valve is in the second position; and a return duct fluidly connecting the inlet of the thermal storage unit to the indoor heat exchanger when the second valve is in the second position when in an auxiliary heating mode; and a defrost loop comprising:

a defrost duct fluidly connected between the thermal storage unit and the outdoor heat exchanger; and a defrost valve positioned in the supply duct and operable to selectively permit refrigerant to flow through the defrost duct, wherein the defrost valve is positionable in a first position to fluidly connect the outdoor heat exchanger to the thermal storage unit to permit refrigerant to flow in the defrost loop therebetween, wherein the second valve fluidly connects the outdoor heat exchanger to the thermal storage unit in the second position when in a defrost mode, wherein the refrigerant is diverted through the auxiliary loop when the first valve is in the second position and the second valve is in the second position when in a defrost mode.

2. The vapor compression system of claim 1 further comprising a reversing valve operable to selectively configure the primary loop to operate in a cooling mode, in which the compressor provides the refrigerant to the outdoor heat exchanger, or a heating mode, in which the compressor provides the refrigerant to the indoor heat exchanger.

3. The vapor compression system of claim 1, wherein the thermal storage unit further comprises a heating element operable to raise a temperature of the plurality of particles.

4. The vapor compression system of claim 3, wherein the heating element heats the plurality of particles to a temperature of between 800 and 1200 F.

5. The vapor compression system of claim 3, wherein the heating element is powered by renewably generated electricity or off-peak electricity.

6. The vapor compression system of claim 1, wherein the plurality of particles are sand particles.

7. The vapor compression system of claim 1, wherein the plurality of particles surround the heating duct to permit heat transfer therebetween.

8. A method of retrofitting an existing vapor compression system with an auxiliary heating loop having a thermal storage unit including a cavity filled with a plurality of particles, the vapor compression system including an indoor heat exchanger, an outdoor heat exchanger, and a compressor fluidly connected between the indoor and outdoor heat exchangers, the method comprising:

fluidly connecting a first path of a first valve between the indoor heat exchanger and the compressor of the existing vapor compression system;

fluidly connecting a first path of a second valve between the indoor heat exchanger and the outdoor heat exchanger of the existing vapor compression system;

fluidly connecting a supply duct between the thermal storage unit and a second path of the first valve, wherein the thermal storage unit is operable at temperatures of up to 1200 F;

fluidly connecting a return duct between a second path of the second valve and the thermal storage unit, fluidly connecting a defrost duct between the thermal storage unit and the outdoor heat exchanger; and fluidly connecting a defrost valve between the supply duct and the defrost duct, the defrost valve operable to selectively permit refrigerant to flow through the defrost duct, wherein the defrost valve is positioned in the supply duct, wherein the defrost valve is positionable to fluidly connect the outdoor heat exchanger to the thermal storage unit to permit refrigerant to flow in a defrost loop therebetween when in a defrost mode, wherein the second path of the second valve fluidly connects the outdoor heat exchanger to the thermal storage unit when in a defrost mode, wherein the refrigerant is diverted through the auxiliary loop in the defrost mode when the first valve is in a second position fluidly connecting the supply duct to the thermal storage unit and the second valve is in the second position connecting the return duct to the outdoor heat exchanger.

9. The method of claim 8, wherein fluidly connecting the return duct comprises connecting the return duct between the second valve and the thermal storage unit such that the indoor heat exchanger is positioned above the thermal storage unit such that flow of a refrigerant through the return duct is driven by gravity.

10. The method of claim 8, wherein fluidly connecting the return duct comprises fluidly connecting a pump in the return duct between the second valve and the thermal storage unit.

11. A controller for a vapor compression system including a primary loop and an auxiliary loop, the primary loop including an indoor heat exchanger, an outdoor heat exchanger, and a compressor, the auxiliary loop including a supply duct, a return duct, a thermal storage unit having a heating duct fluidly connecting the supply duct and the return duct, a defrost duct fluidly connected between the thermal storge unit and the outdoor heat exchanger, a defrost valve positioned within the supply duct and operable to selectively permit refrigerant to flow through the defrost duct, the thermal storage unit including a cavity filled with a plurality of particles, the thermal storage unit operable at temperatures of up to 1200 degrees Fahrenheit, the primary and auxiliary loops being connected by first and second valves, the controller comprising:

a processor; and a memory storing instructions that program the processor to:

operate the vapor compression system to provide a flow of refrigerant through the primary loop;

determine if a condition has been satisfied by determining that a temperature of the outdoor heat exchanger has fallen below a threshold value; and adjust a position of the first valve to fluidly connect the supply duct to the outdoor heat exchanger and a position of the second valve to fluidly connect the outdoor heat exchanger to the return duct to and divert the refrigerant through the auxiliary loop when the condition is satisfied.

12. The controller of claim 11, wherein the instructions program the processor to:

determine if a second condition has been satisfied; and adjust the position of the first valve to fluidly connect the indoor heat exchanger to the supply duct and adjust the position of the second valve to fluidly connect the indoor heat exchanger to the return duct when the second condition has been satisfied.

13. The controller of claim 12, wherein the instructions program the processor to determine if a third condition has been satisfied by determining that a utility high demand event has occurred.

14. The controller of claim 12, wherein the instructions program the processor to determine if a third condition has been satisfied by determining that high stage heating is needed.

* * * * *